US007277069B2

(12) United States Patent
Hoppenbrouwers et al.

(10) Patent No.: US 7,277,069 B2
(45) Date of Patent: Oct. 2, 2007

(54) PARTIAL LINE DOUBLING DRIVING METHOD AND DISPLAY DEVICE USING THE SAME

(75) Inventors: Jurgen Jean Louis Hoppenbrouwers, Eindhoven (NL); Roy Van Dijk, Eindhoven (NL); Roel Van Woudenberg, Eindhoven (NL)

(73) Assignee: Koninklijke Philips Electronics N. V., Eindhoven (NL)

( * ) Notice: Subject to any disclaimer, the term of this patent is extended or adjusted under 35 U.S.C. 154(b) by 324 days.

(21) Appl. No.: 10/483,855

(22) PCT Filed: Jul. 18, 2002

(86) PCT No.: PCT/IB02/03127

§ 371 (c)(1),
(2), (4) Date: Jan. 14, 2004

(87) PCT Pub. No.: WO03/010743

PCT Pub. Date: Feb. 6, 2003

(65) Prior Publication Data

US 2004/0160401 A1 Aug. 19, 2004

(30) Foreign Application Priority Data

Jul. 20, 2001 (EP) ..... 01202782

(51) Int. Cl.
*G09G 3/28* (2006.01)
*G09G 5/10* (2006.01)
*G09G 3/36* (2006.01)

(52) U.S. Cl. ..... 345/63; 345/690; 345/89

(58) Field of Classification Search ..... 345/55, 345/60, 63, 68, 76–77, 82–83, 87–89, 204, 345/690, 692; 315/169.1–169.4
See application file for complete search history.

(56) References Cited

U.S. PATENT DOCUMENTS 6,088,012 A * 7/2000 Shigeta et al. ..... 345/63
6,297,788 B1 * 10/2001 Shigeta et al. ..... 345/63

* cited by examiner

*Primary Examiner*—Amr A. Awad
*Assistant Examiner*—Stephen G Sherman

(57) ABSTRACT

A display device (1) of the matrix type is addressed using partial line doubling, i.e. a method in which one or more sub-fields for pixels are doubled, meaning that the same data is used for a set of pixels. Adjacent pixels in a row are addressed using different grey level realizations by applying different combinations of subfields. Partial line doubling is performed on sets of adjacent pixels in a column that are addressed using the same grey level realization. Two different addressing schemes may be used by applying either the standard pattern A/B or the second pattern (n×1 A/B). When applying the latter pattern partial line doubling is performed in a line skipping fashion.

9 Claims, 9 Drawing Sheets

PARTIAL LINE DOUBLING DRIVING METHOD AND DISPLAY DEVICE USING THE SAME

The invention relates to a method of determining new luminance value data based on original luminance value data to be displayed on a matrix display device, having pixels arranged in rows and columns, where said luminance value data are coded in sub-fields wherein common values for a number of sub-fields are determined for a set of lines.

The invention also relates to a matrix display device comprising means for determining new luminance value data based on original luminance value data to be displayed on a matrix display device in accordance with said method.

The invention may be used, for example, in plasma display panels (PDPs), plasma-addressed liquid crystal panels (PALCs), liquid crystal displays (LCDs), Polymer LEDs (PLEDs), and Electroluminescent (EL) displays used for personal computers, television sets and so forth.

A matrix display device comprises a first set of data lines (rows) $r_1 \ldots r_N$ extending in a first direction, usually called the row direction, and a second set of data lines (columns) $c_1 \ldots c_M$ which extend in a second direction, usually called the column direction, and intersect the first set of data lines, each intersection defining a pixel (dot).

A matrix display device also comprises means for receiving an information signal comprising information on the luminance value data of lines to be displayed and means for addressing the first set of data lines (rows) $r_1, \ldots r_N$ in dependence on the information signal. Luminance value data are hereinafter understood to be the grey level in the case of monochrome displays and each of the individual levels of the color components (e.g. RGB) in the case of color displays.

Such a display device may display a frame by addressing the first set of data lines (rows) line by line, each line (row) successively receiving the appropriate data to be displayed.

For the above-mentioned matrix display panel types, the generation of light cannot be modulated in intensity to create different levels of grey scale, as is the case for CRT displays. On the matrix display panel types, grey levels are created by modulating in time: for higher intensities, the duration of the light emission period is increased. The luminance data are coded in a set of sub-fields, each having an appropriate duration or weight for displaying a range of light intensities between a zero and a maximum level. Different combinations of sub-fields result in different grey levels. This sub-field decomposition, described here for grey scales, will also apply hereinafter to the individual colors of a color display.

In order to reduce the time necessary for displaying a frame, a multiple line addressing method may be applied. In this method, more than one (usually two) neighboring, and preferably adjacent lines of the first set of data lines (rows) are simultaneously addressed, receiving and displaying the same data.

This so-called double-line addressing method (when two lines are simultaneously addressed) effectively allows speeding up of the display of a frame, because each frame requires less addressing actions, be it at the expense of a loss of the quality with respect to the original signal, because each pair of lines receives the same data. This may induce a loss of resolution and/or sharpness due to the duplication of the lines.

In order to reduce the loss of resolution while still gaining time, line doubling can be done for only some sub-fields. Partial line doubling will thus yield less loss of resolution.

The use of partial line doubling should be effective. Only a few sub-fields doubled would yield only little gain of time. Too many sub-fields doubled would yield an unacceptable loss of picture quality.

Another aspect that influences the quality is the driving method of the pixels and the calculation method of the new data of doubled sub-fields. Different calculation methods giving different results can be used. The method used should give the best picture quality, as seen by the observer's eyes. The picture quality is also dependent on perceived image errors, such as motion artifacts like dynamic false countering.

The following simple methods can be used for the doubling of sub-field data:

The data of the sub-fields to be doubled on odd lines is used on the adjacent even lines (simple copy of bits).

The data of the sub-fields to be doubled on even lines is used on the neighboring or adjacent odd lines (simple copy of bits).

The average data of the sub-fields to be doubled of each pair of pixels is used for both new sub-field values.

An error minimization algorithm may be used that also incorporates the subfields that are not line doubled in the calculation. For an example of such an error minimization algorithm reference is made to 'Address Time Reduction in PDPs by means of Partial Line Doubling' by J. Hoppenbrouwers, R. van Dijk and T. Holtslag, SID 01 Digest, part 43.4.

Such methods allow a reduction of the addressing time, be it at the expense of some loss of resolution, depending on the selected subfields that are doubled in the partial line doubling scheme.

Using non-binary sub-fields, i.e. sub-fields that have a non-binary distribution (for example, sub-fields with weights 12, 8, 4, 2, 1, 4, 8, 12), yields an improved moving image quality. Within a general non-binary sub-field distribution, the same grey level can be obtained by choosing different combinations of sub-field values. Different choices of sub-field combinations are denominated 'different non-binary coding', although the weights may well be the same, and only the choice of realization differs. For ease of definition a particular combination of weights will hereinbelow be called a grey level realization. Using different grey level realizations for pixels adjacent to each other in a row has the effect that, although adjacent pixels have the same grey level in a field time, they are not lit at exactly the same time but at different time periods in a field time. For example, a grey level of '12' can be made by the first sub-field '12', the last sub-field '12', a combination of the first sub-field '8' and the first or the last sub-field '4' (note that for these two realizations the weights are the same, i.e. 8+4, but the realization is not). Choosing different non-binary coding for adjacent pixels in a row and column direction (creating a "checkerboard" pattern) has the effect that motion artifacts are less visible, because the motion artifacts are different for different grey level realizations; consequently, a smoothing effect occurs.

When combining partial line doubling and non-linear binary subfields, the method to reduce motion artifacts by applying different non-binary coding for adjacent pixels in a checkerboard fashion does not work properly for the sub-fields on which line doubling is applied.

It is an object of the invention to provide an improved picture quality. The invention is defined by the independent claims. The dependent claims define advantageous embodiments.

To this end, the method in accordance with a first embodiment of the invention is characterized in that the original data are coded in a non-binary code of sub-fields, the non-binary code of the sub-fields being different for pixels adjacent to each other in a row, and that the common values for sub-fields are determined for sets of pixels in a column coded in the same non-binary code.

Within this embodiment of the invention partial line doubling is performed on sets of pixels in a column that use the same non-binary code. As a consequence very effective partial line doubling is possible, while the partial line doubling does not have a substantial negative effect on the image quality, as for example, a kind of checkerboard pattern of different non-binary codes is applied to minimize artifacts.

The method in accordance with an alternative embodiment for the first embodiment of the invention is characterized in that the original data are coded in a binary distribution of sub-fields, the binary coding of the sub-fields having a different temporal sequence within a frame time for pixels adjacent to each other in a row, and that the common values for sub-fields are determined for sets of pixels in a column addressed in the same temporal sequence.

The problems encountered when using the standard binary distribution (i.e. 1,2, 4, 8, 16 etc), can at least partially be reduced by using a different temporal distribution for adjacent (within a row) pixels, for example, for one pixel the temporal distribution is chosen as 1, 2, 4, 8, 16, while for the next pixel the temporal distribution is chosen as 16, 8, 4, 2, 1. The difference in temporal distribution will have the effect that adjacent pixels while having the same grey value (for instance 5), are not lit simultaneously but at different time slots within a field time.

In this embodiment of the invention partial line doubling is performed on sets of pixels in a column that are addressed with the same temporal sequence. As a consequence very effective partial line doubling is possible, while the partial line doubling does not have a substantial negative effect on the image quality.

It should be noted that in the first embodiments as well as in the alternative embodiment different grey level realizations are obtainable by making different combinations of subfields with different individual weight, which, when added, have the same weight or by combinations of subfields with a same weight, but with different timings.

Preferably the sub-fields with the lowest one or two values (1 or 2) are not doubled while higher sub-fields are.

The inventors have realized and experiments have shown that rather than doubling the sub-fields with the lowest value, a shift in doubling, i.e. doubling a set of sub-fields higher than the lowest sub-fields, greatly improves the image quality, especially the still image quality.

It is also advantageous if the described addressing for all subfields is realized in an interlaced way. In that case cross talk effects are reduced, like for example the effects of reduced addressing margins or pixel errors (which result for example in a pixel emitting light, while it should be black).

The invention also relates more in particular to a matrix display device comprising a display panel having a set of lines of pixels, a data-processing unit for receiving an input signal representing successive frames comprising original line luminance values of pixels to determine new luminance values of the pixels on the basis of the original line luminance values, and a driver circuit for supplying the new line luminance value data to the lines, the driver circuit having means for addressing groups of g lines with the same values for selected sub-fields.

These and other aspects of the invention are apparent from and will be elucidated with reference to the embodiment(s) described hereinafter with reference to the accompanying drawings.

In the drawings:

FIG. 1 schematically shows a matrix display device;

Figure 3A:
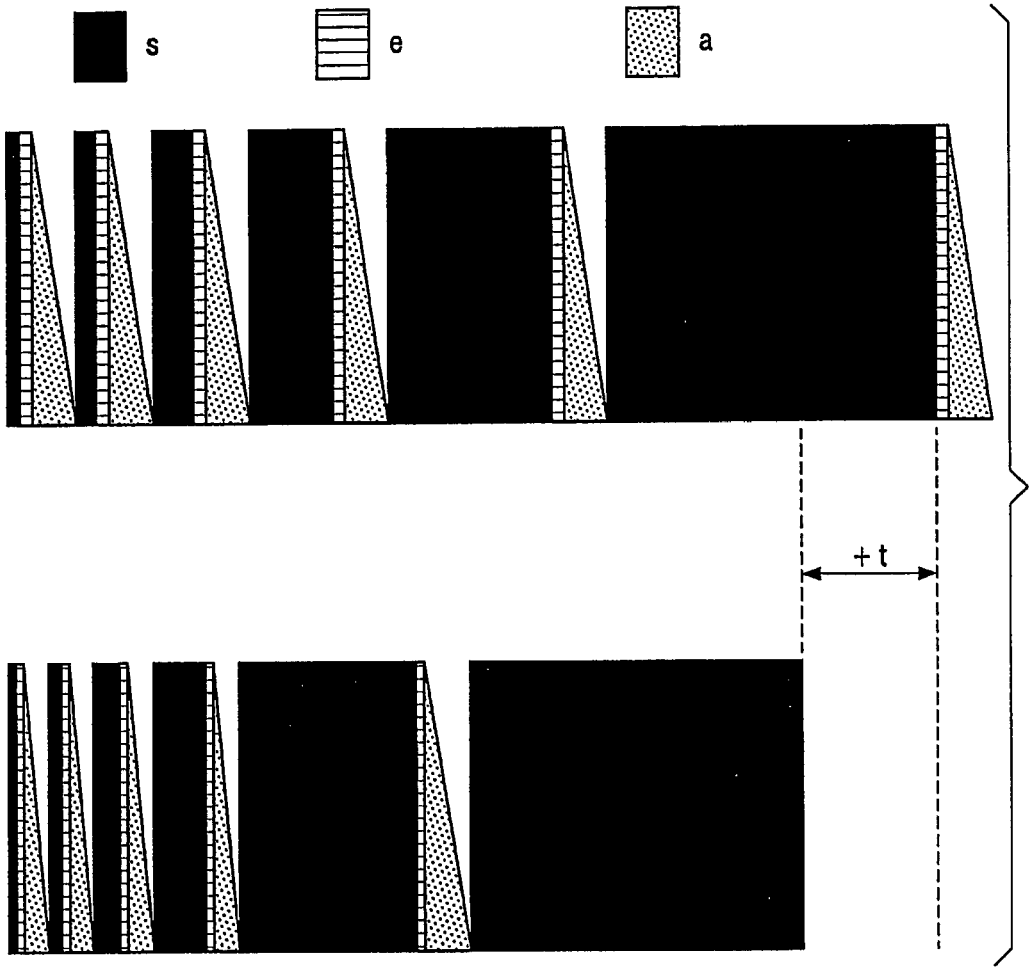
FIG. 3A illustrates a partial line doubling scheme.
Figure 3B:
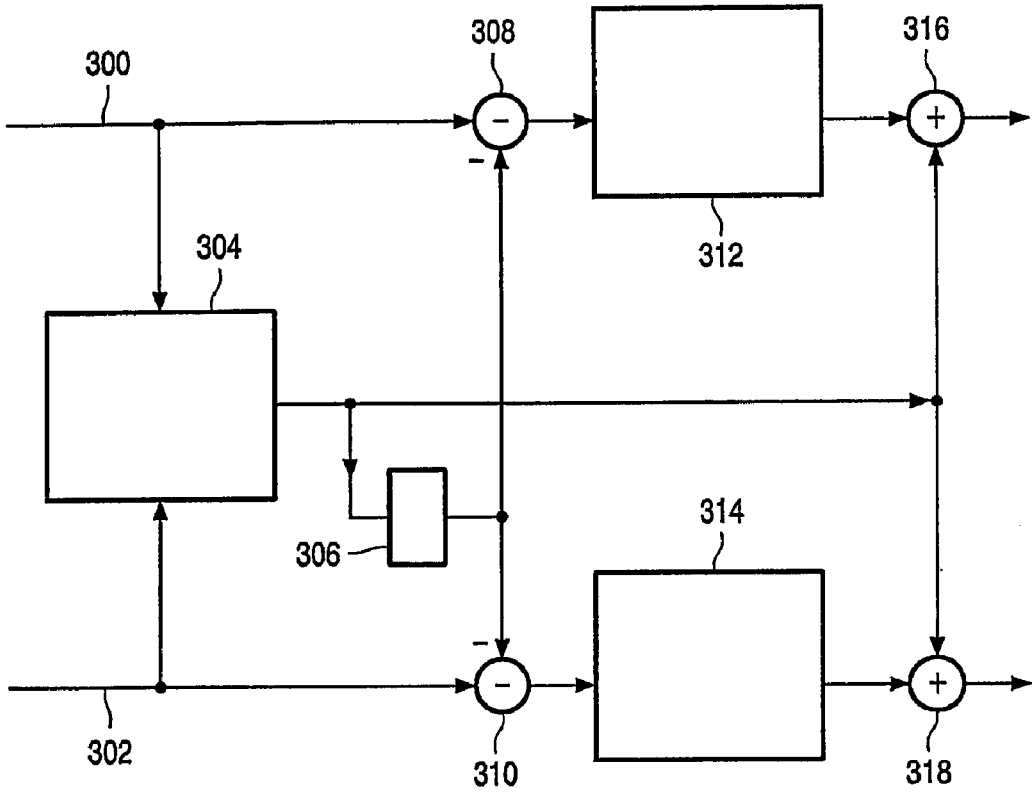

FIG. 3B does the same in an algorithm form

Figure 4A:
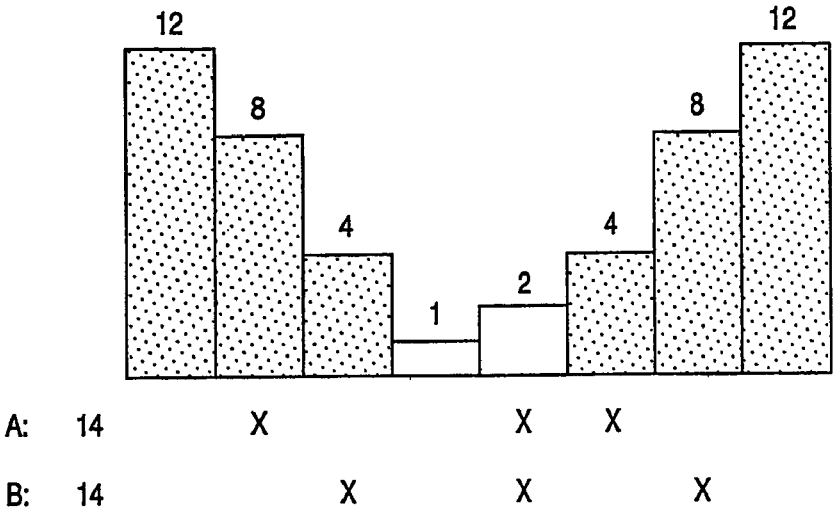
Figure 4B:
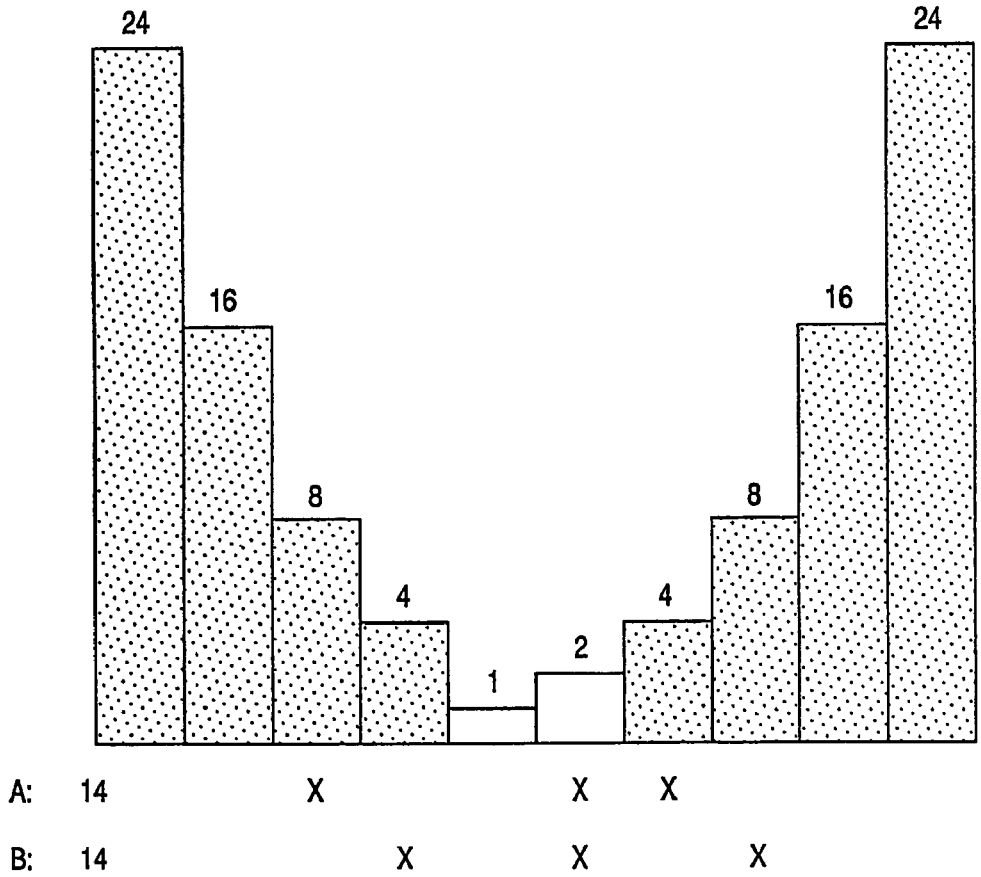

FIGS. 4A and 4B schematically show two different non-binary sub-field distributions with for each distribution two ways of forming a '14' grey field.

FIG. 5 schematically shows two different arrangements for distributed nonbinary sub-field distributions.

Figure 6:
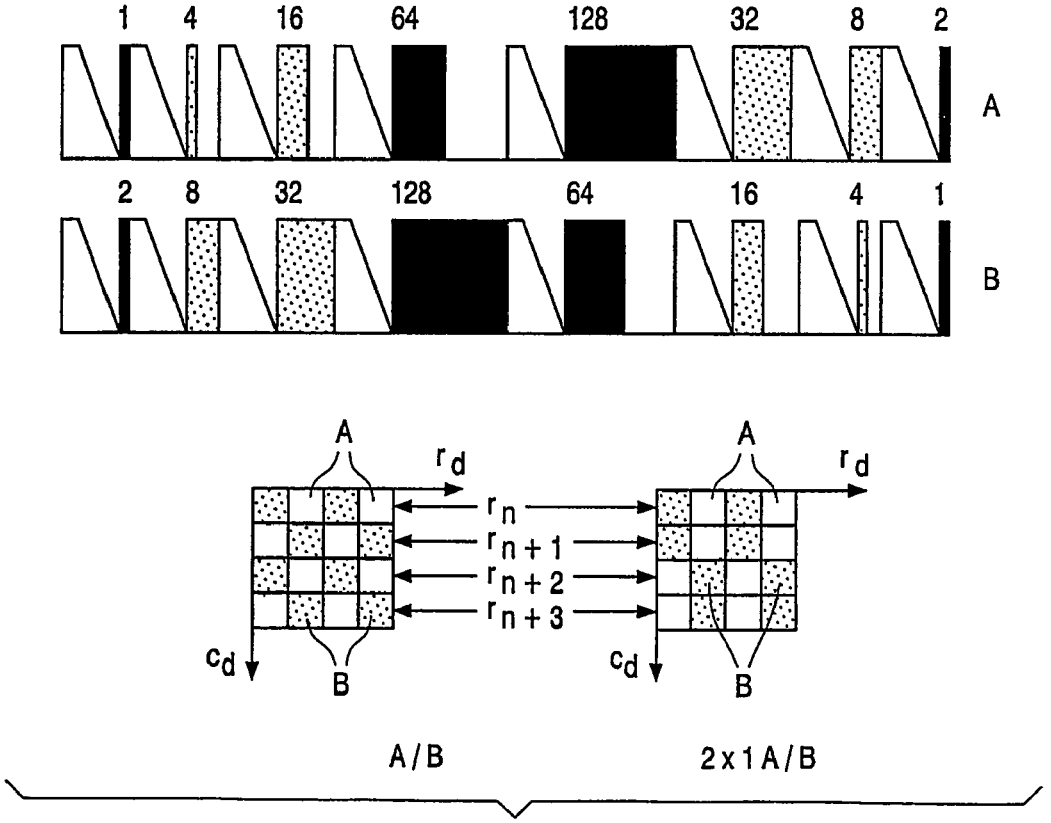

FIG. 6 schematically illustrates binary codes with different temporal sequences.

Figure 7A:
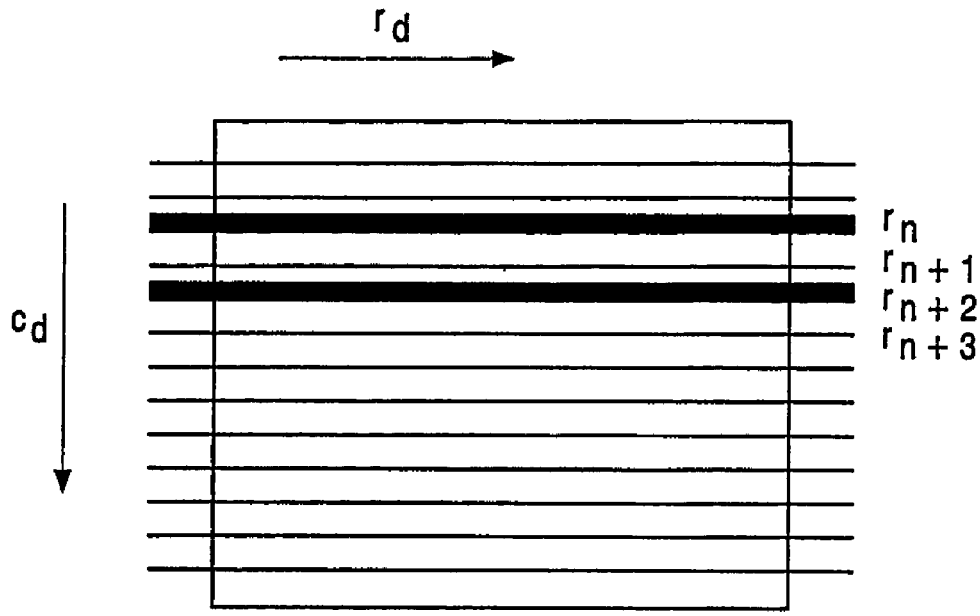
Figure 7B:
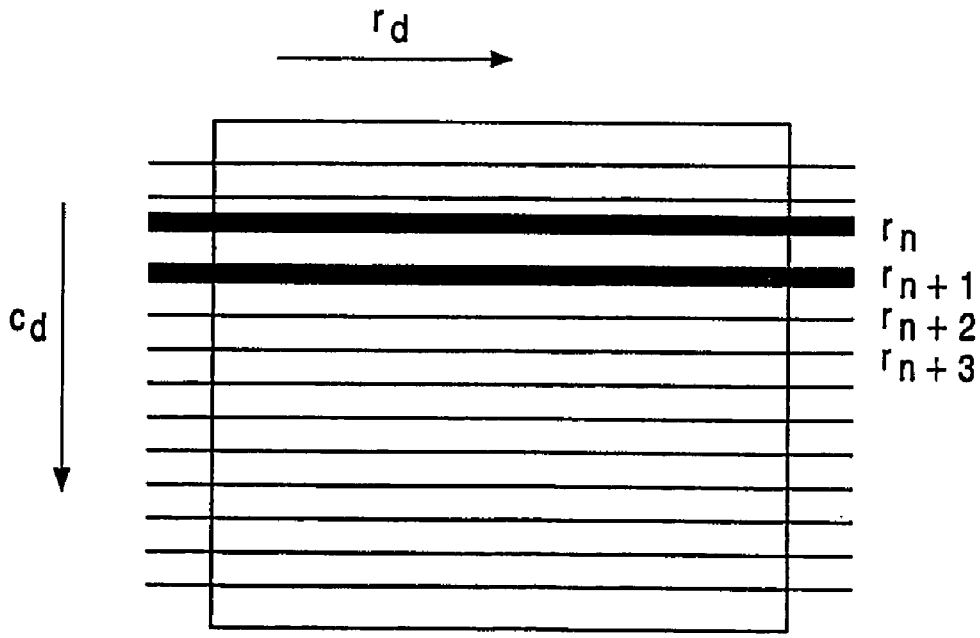

FIG. 7 shows the partial line doubling scheme for FIG. 5.

Figure 8:
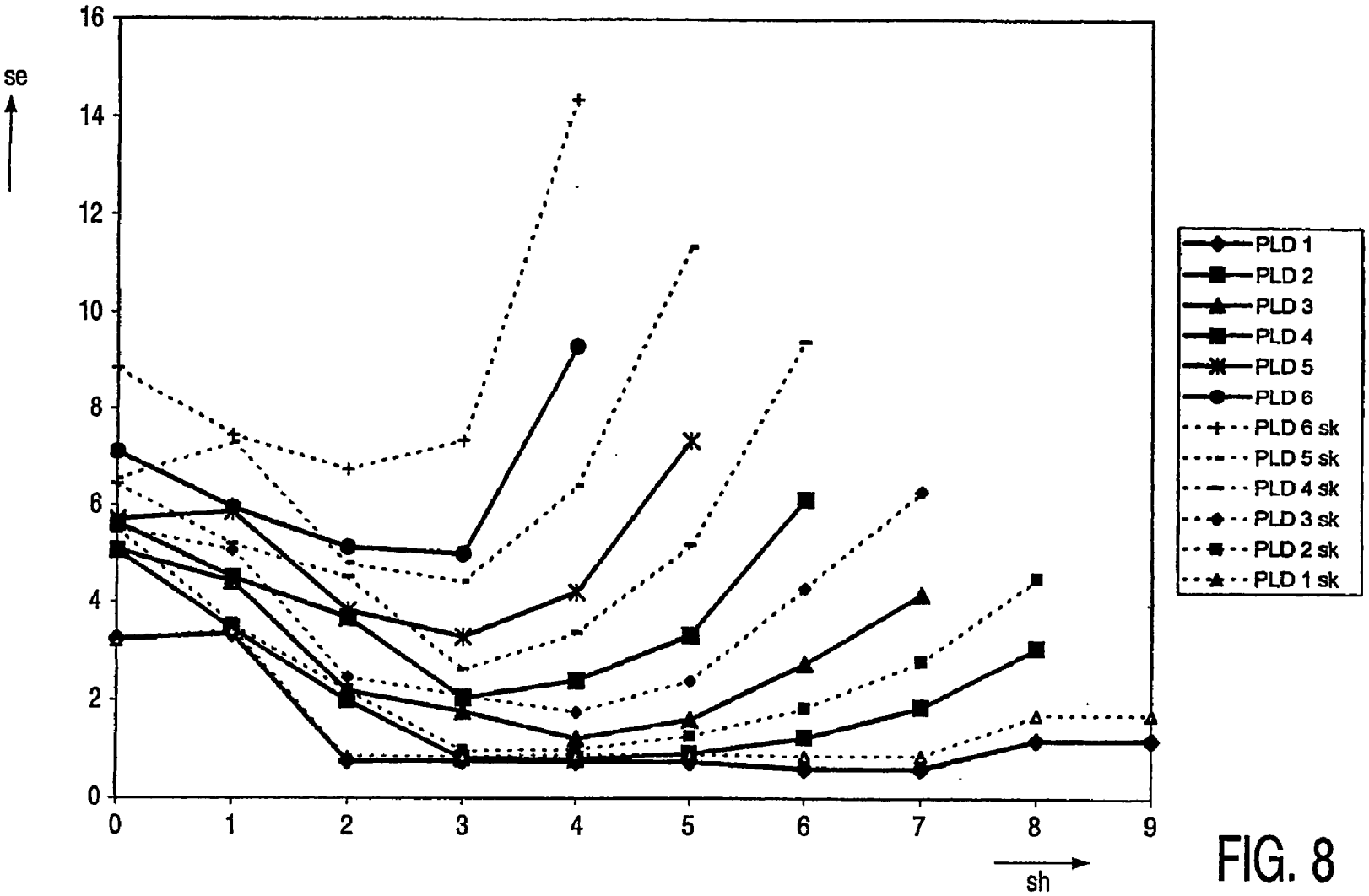

FIG. 8 shows the still error as a function of sub-field doubling shift.

Figure 9:
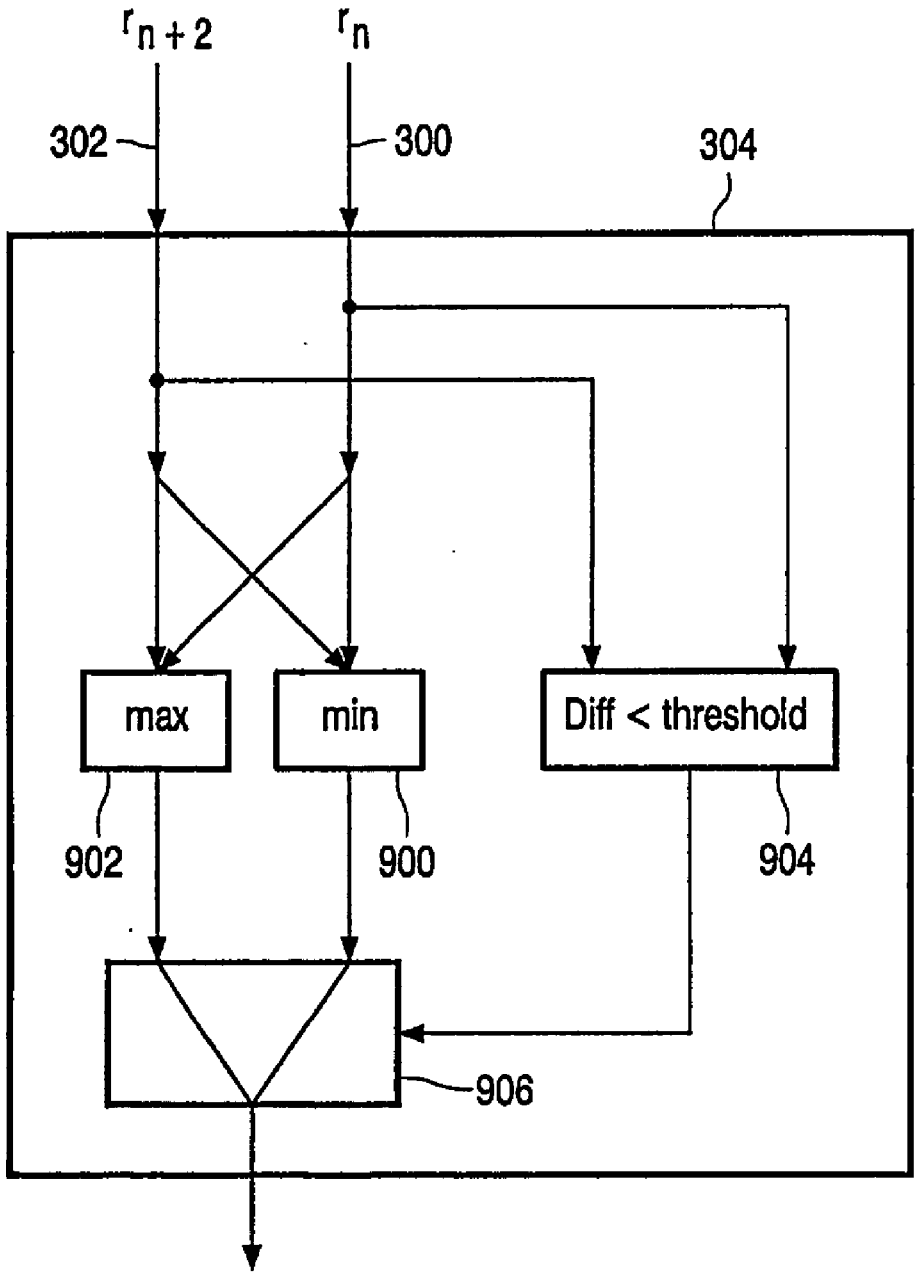

FIG. 9 illustrates a scheme for doubling of sub fields.

Figure 10:
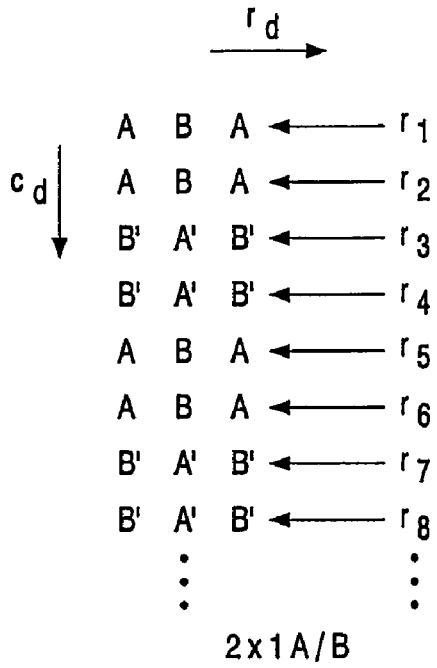

FIG. 10 shows a second interlace embodiment combining interlaced addressing of non-doubled subfields with interlaced addressing of doubled subfields of pairs of lines.

Figure 11:
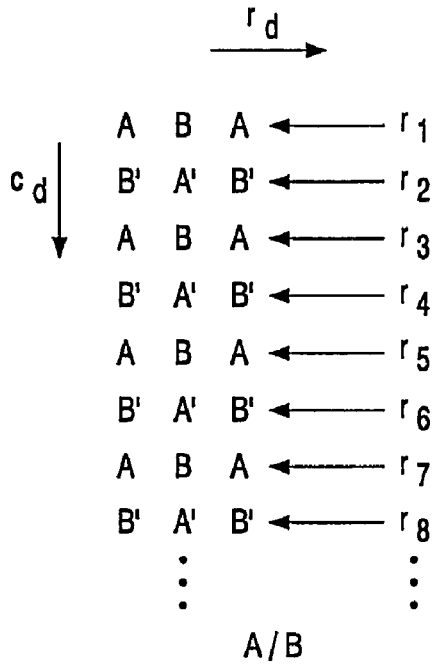

FIG. 11 shows a third interlace embodiment combining interlaced addressing of non-doubled subfields with interlaced addressing of doubled subfields in a line skipping manner.

Figure 1:
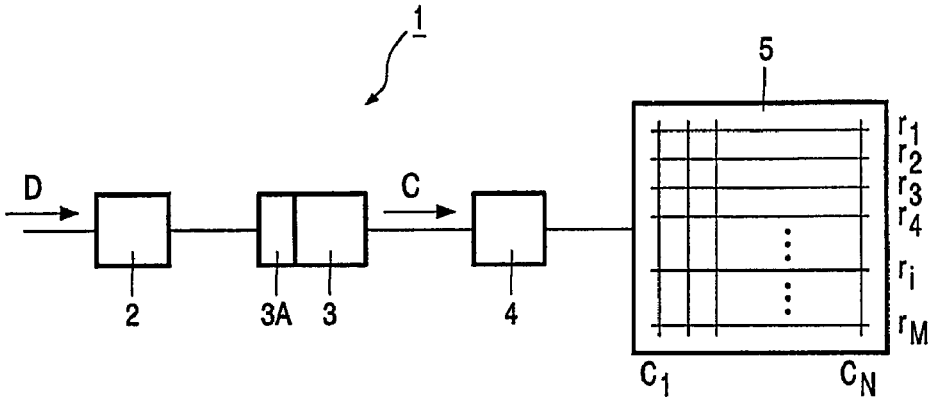

FIG. 1 is a diagram of a device comprising a matrix display panel 5, showing a set of display lines (rows) $r_1$, $r_2, \ldots r_M$. The matrix display panel 5 comprises a set of data lines (columns) $c_1 \ldots c_N$ extending in a second direction, usually called the column direction, intersecting the display lines, each intersection defining a pixel (dot) $d_{11} \ldots d_{NM}$. The number of rows and columns need not be the same.

The matrix display also comprises a circuit 2 for receiving an information signal D comprising information on the luminance of lines of pixels to be displayed and a driver circuit 4 for addressing the set of data lines ($C_1, \ldots C_N$) in dependence on the information signal D, which signal comprises original line luminance values $D_1, \ldots D_N$.

The display device in accordance with the invention comprises a computing or data processing unit (3) for computing new line luminance values C of pixels $d_{11}, \ldots d_{NM}$ on the basis of original line luminance values $D_1$, $D_2, \ldots D_N$. In preferred embodiments the unit 3 may comprise a motion determinator 3*a* to determine the amount of motion of the image (see below).

Figure 2:
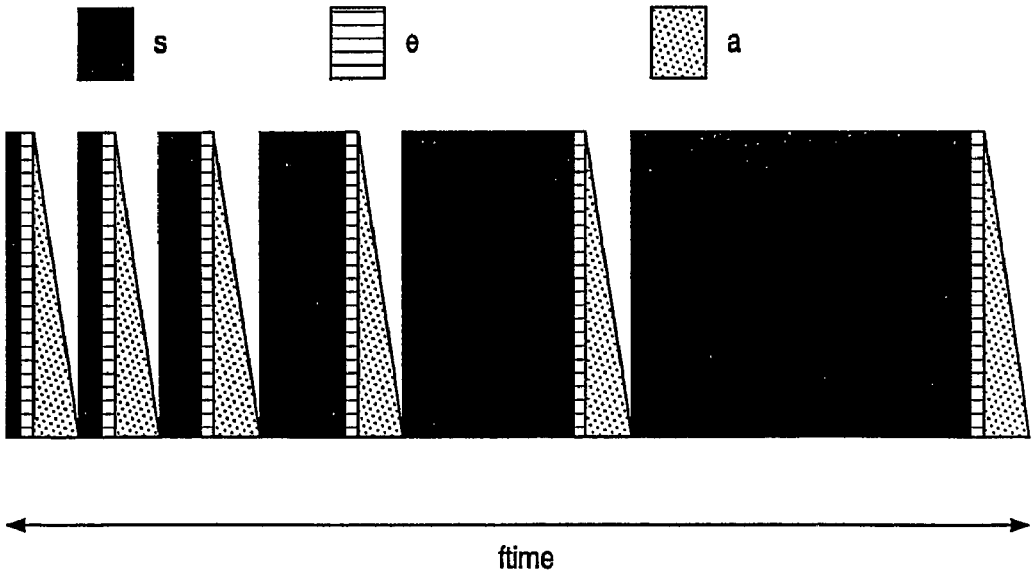
FIG. 2 illustrates a sub-field addressing scheme.

FIG. 2 illustrates a so-called sub-field addressing scheme, in this example for a plasma display. It is used for creating grey levels since a single plasma cell can only be turned off and on. An example of such a scheme is shown in FIG. 2. A total field time is divided in sub-fields (6 in this case) and each of the sub-fields consists of three phases, i.e. the erase and set-up phase (e) (in which all pixels are reset), the address phase (a) (in which pixels that should emit light are primed) and the sustain phase (s) (in which primed pixels generate light). Such sub-field addressing schemes have two major drawbacks. Within each sub-field period, the panel has to be addressed line at a time, which is very time consuming. Consequently the larger part of one TV field period is used for addressing. The time that is left for sustaining the panel (i.e. for light emission) is limited. Therefore a reduction of the addressing time is desirable, this can be accomplished by using partial line doubling, i.e. line doubling of some sub-fields. Another problem concerns motion artifacts.

FIG. 3A illustrates the effect of partial line doubling. As discussed above the bulk of one field time is used for addressing the display (as can be seen in the upper half of FIG. 3A). The sustain time can be increased by reducing the addressing time by partial line doubling. The basics of such partial line doubling are schematically shown in the lower half of FIG. 3A. In this example some of the sub-fields on adjacent or nearby lines are addressed with the same data by the same driver, resulting in a reduction of the addressing time. As a result there is time gain given by +t in FIG. 3A. Because of the time gain +t the percentage of sustain time can be increased.

FIG. 3B illustrates schematically partial line doubling. This Figure can be seen as illustrating the algorithm whereby the new data are calculated, as well as indicating data flows and functional parts of unit 3 for calculating new data. The original grey level data of the first line 300 and the second line 302 (which could be adjacent or near each other) are analyzed. In a determinator 304 (comprised in unit 3) the values of the sub-field to be doubled are determined. The new doubled sub field data could either be the original sub field data of the line doubled sub-fields of the first line, of the second line, an average of the two or some preferred value calculated by an algorithm on the basis of the original sub field data. Use can be made of a look-up table 306 in which grey level data can be found corresponding to the new doubled subfields of the first and the second line. The values grey level corresponding to the sub-fields to be doubled, are subtracted in sub-tractors 308 and 310 (in unit 3) from the respective original grey level data 300 and 302. Depending on the result of this subtraction, the sub-fields of the first line and the second line which are not to be doubled are determined in determinators 312 and 314 (in unit 3). The new doubled sub-field data are combined, in respective adders 316 and 318, with the new sub-field data of the remaining sub-fields of the first line, respectively the second line, so as to form the output data of the first, respectively the second line. Functional elements of unit 3 (determinator, subtractor, adder, look-up table) can be an integral part of such unit 3 or separate elements connected to this unit so as to perform the relevant function. Such functional elements may be in the form of hard-ware (e.g. a dedicated circuit such as a subtractor circuit) or soft-ware (e.g. a program or part of a program for performing the relevant calculation or comparison). A single structural element or program may perform one or more of the relevant functions.

Sub-field doubling can be done on non-binary sub-field distributions.

Non-binary sub-field distributions enable a certain grey level (for instance '14') to be formed in different manners. FIGS. 4A and 4B show two different non-binary subfield distributions. FIG. 4A shows a distribution 12, 8, 4, 1, 2, 4, 8, 12, while FIG. 4B shows a distribution 24, 16, 8, 4, 1, 2, 4, 8, 16, 24. FIG. 4A shows that grey level '14' can be obtained via two different realizations A and B (see crosses, indicating selected subfields for coding A, respectively for coding B). FIG. 4B shows likewise that grey level '14' can be obtained via two different realizations (A and B). Each realization of a grey level is called a grey level realization. Using a set (i.e. having more than one possibility) of grey level realizations allows the same grey level in nearby pixels to be formed differently. Because, consequently, nearby pixels, although showing the same grey level, are actually lit at different times (see FIGS. 4A and 4B), motion artifacts are strongly reduced. Motion artifacts are usually caused by the fact that the actual time slot(s) in which the pixel is lit is dependent on the intensity. The perceived position of a moving object, therefore, becomes dependent on its grey level. By using two different grey level realizations, the motion artifact, seen for one pixel alone, remains the same. However, since the motion artifacts are different for the different grey level realizations, there is a smoothing effect. Motion artifacts are thus reduced.

Figure 5A:
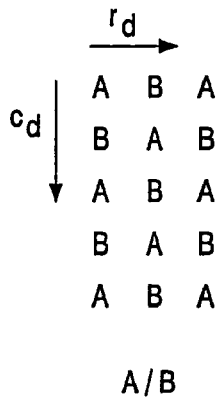

FIG. 5 illustrates two different arrangements for using different grey level realizations. The first part of the FIG. (FIG. 5*a*) shows an arrangement in which a pure checkerboard arrangement is chosen, i.e. the first A and the second grey level realization B is chosen in an alternating fashion in the row direction $r_d$ and in the column direction $c_d$.

The second part of the FIG. (*b*) shows an arrangement in which the two grey level realizations alternate in the row direction while in the column direction alternating pairs of pixels with the same grey level realizations are present.

Figure 5B:
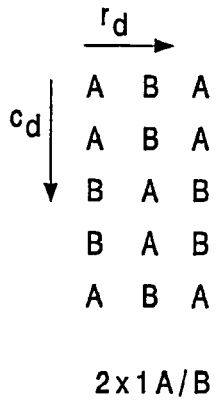

According to the invention partial line doubling is performed on the schemes in which (as in FIG. 5) different grey level realizations are used, but doubling is performed on pixels that have the same non-binary coding. In FIG. 5*a* the simplest of such schemes is shown. In FIG. 5*b* a more complex scheme is shown. Hereinbelow the scheme as shown in FIG. 5*a* is called the standard pattern A/B, whereas the scheme as shown in FIG. 5*b* is called the second pattern 2×1 A/B. FIGS. 4A, 4B, 5A and 5B illustrate embodiments of the invention in which the data is coded using a non-binary subfield distribution. FIGS. 4A, 4B and 5 illustrate that a smoothing effect on motion artifacts can be obtained by using different non-binary grey level realizations for adjacent pixels.

The upper part of FIG. 6 illustrates two different temporal sequences A and B for binary subfield distributions. These binary distributions do not differ in the manner that different sets of numbers are added to each other to form a particular grey value (i.e. 14 would but in the realization A as well as in realization B be formed by 8+4+2), but the temporal sequence of the bits during a same field period is different. As a consequence, for the same grey value a pixel is lit during different time slots within a field period when using the grey level realization A based on the temporal sequence A compared to when using the grey level realization B based on the temporal sequence B. This will spread out and thereby smooth motion errors. The lower part of FIG. 6 illustrates schematically that with the two temporal sequences (realizations) A and B, as with the realizations A and B of the FIGS. 4A and 4B, a standard pattern A/B as well as a second pattern 2×1 A/B can be formed. In the standard pattern A/B adjacent pixels in a row as well as in a column are driving using different realizations A,B; in the second pattern 2×1 A/B adjacent pixels in a row are driven using different realizations A,B, but, seen in a column direction $c_d$ pairs of adjacent pixels are driven using the same realizations A,B, while adjacent pairs are driven using different realizations. The lower left part of FIG. 6 illustrates that the standard pattern A/B uses partial line doubling with line skipping, i.e. row $r_n$ and row $r_{n+2}$ are partial line doubled, then row $r_{n+1}$ and row $r_{n+3}$ etc. The lower right part of FIG. 6 illustrates that the second pattern 2×1 A/B performs partial line doubling on a pair of adjacent rows, i.e. the rows $r_n$ and $r_{n+1}$, then rows $r_{n+2}$ and $r_{n+3}$, etc.

FIG. 7 illustrates how partial line doubling is performed for the two patterns A/B, 2×1 A/B shown in FIGS. 5 and 6. In the standard pattern A/B partial line doubling is performed on the row $r_n$ and $r_{n+2}$ (shown as black bars), then $r_{n+1}$and $r_{n+3}$ etc. In other words, partial line doubling is performed on a line skipping manner, the sub-fields of pairs of pixels in a column separated by a row (i.e. skipping one line) are doubled, which means that each time, the sub-fields to be doubled of two odd or even rows are addressed simultaneously. Comparing FIG. 7(*a*) with the scheme in FIG. 5(*a*) reveals that the sub-fields to be doubled are sub fields with the same realizations (either A or B). The same applies when FIG. 7(*b*) is compared with FIG. 5(*b*). In case of the second pattern 2×1 A/B partial line doubling is performed on adjacent lines, so the rows $r_n$ and $r_{n+1}$ (shown as black bars), then the rows $r_n$ +2 and $r_{n+3}$ etc. Experiments show that applying the above described combination of partial line doubling and the patterns A/B, 2×1 A/B yields a clear improvement of the picture quality of moving images.

The standard pattern A/B is a preferred scheme when motion artifacts are considered. The second pattern 2×1 A/B is preferred when the still image quality is considered. The second pattern 2×1 A/B is an example of the more general type of n×1 A/B patterns.

However, if the number of sub-fields that is addressed with partial line doubling is increased a decrease of still picture quality is encountered. In a preferred embodiment motion is detected by a motion detector. The amount of motion is compared to a set value. When the amount of motion is below a set value, partial line doubling is performed on adjacent lines and the 2×1 A/B scheme is used. If the amount of motion is higher than the set value, the A/B scheme is used and partial line doubling is used in a line skipping manner. In the schematic algorithm illustrated in FIG. 1 this amounts to performing a motion detection so as to determine the amount of motion (by comparing, for example, subsequent frames and detecting the amount of motion, i.e. change between the frames) and comparing the found amount in a comparator with a set value and if the found value is below the set value, performing the partial line doubling on adjacent lines. To this end, the unit 3 may comprise a motion determinator and comparator. This motion determinator and comparator will determine the amount of motion in the image and works (depending on the outcome of the comparison) as a switch to perform the algorithm schematically indicated in FIG. 3B or a similar algorithm on adjacent lines or in a line skipping manner or, seen in function terms, to set into action the elements in the unit 3 to perform the functions corresponding to the steps in the algorithm.

FIG. 8 shows the effect of shifting the partial line doubled field, i.e. not doubling the lowest value fields (i.e., 1, 2 etc) but a set of higher value sub-fields. On the horizontal axis the shift Sh is given (in this example a non-binary code of 10 sub fields were used). A shift Sh has a reducing effect on the still error Se (shown on the vertical axis) with a maximum effect for a shift Sh of approximately 2-4 sub-fields. A shift Sh of three means that the three lowest valued sub fields are not doubled. The different lines are for different numbers of sub fields being doubled; PLD 1, for example, stands for only one sub field being doubled, so PLD 1 with a shift of three means that the fourth smallest sub field is doubled, PLD 2 with a shift of four means that sub fields 5 and 6 are doubled etc. The solid lines stand for partial line doubling without line skipping, the dotted lines for partial line doubling with line skipping PLD 1 Sk . . . PLD6Sk. All lines show that a shift of 1, or preferably 2 or more reduces the still error.

Any partial line doubling method will introduce errors. Such errors are, as a rule, more visible in dark areas than in light areas. In the determinator 304 of FIG. 3B the decision is made on which line the error is placed. This is done by choosing the sub-field values of the line with the highest or lowest intensity. A luminance difference in dark picture areas is more visible than a difference in a bright area. Thus the value of the sub fields of the pixel with the lowest intensity are preferably doubled; this will be called hereinbelow 'minimum operation'. The opposite, i.e. a doubling of the sub field values of the pixel with the highest intensity, is hereinbelow called 'maximum operation'. The inventors have realized that performing a 'maximum operation' is favorable with respect to motion artifacts. Motion artifacts are most annoying in areas with a gradually changing luminance, i.e. with small differences between luminances.

In preferred embodiments of the invention therefore the difference between the original luminance values of pixels is compared in a comparator 904 as shown in FIG. 9 and, when the difference is smaller than a threshold value, the maximum operation is performed by selecting in selector 906 the output of the "max"-unit 902, comprising the luminance values of the row $r_n$ or $r_{n+2}$ with the highest luminance values. Likewise, when comparator 904 detects a difference above a threshold, the minimum operation is performed by selecting in selector 906 the output of the "min" unit 900, comprising the luminance values of the row with the lowest luminance values. Another possible criterion could be to check whether one of the two input luminances is smaller than a certain threshold value. If so, a minimum operation is performed.

The described embodiments can also be combined with an interlaced addressing scheme, which has the advantage that crosstalk is reduced. It should be noted that lines that are doubled, apply the same data for the subfields that are doubled in those lines. As these data for adjacent lines are the same, the problem of crosstalk is strongly reduced for the doubled subfields. So, a first interlace embodiment applies interlace only to the non-doubled subfields of adjacent lines, while the doubled subfields can have any of the before mentioned addressing patterns.

A second interlace embodiment is obtained by combining interlaced addressing of non-doubled subfields with interlaced addressing of doubled subfields of pairs of lines, to which the second pattern 2×1 A/B is applied as addressing scheme. This is illustrated in FIG. 10. Firstly by the pairs of lines containing the A, B patterns are addressed, so row $r_1$ together with row $r_2$, next row $r_5$ together with $r_6$, etc. Once all these pairs have been addressed the skipped pairs are addressed, so containing the A', B' patterns, so row $r_3$ together with $r_4$, next row $r_7$ together with row $r_8$ etc. By applying this scheme for the doubled subfields, it is avoided that two subsequent lines with different data (like row $r_2$ and $r_3$) are addressed immediately after each other, so crosstalk is avoided.

A third interlace embodiment combines interlaced addressing of non-doubled subfields with interlaced addressing of the doubled subfields in a line skipping manner. FIG. 11 shows that interlaced addressing is applied to doubled subfields of pairs of adjacent odd lines, respectively pairs of even lines, which are addressed using the standard pattern A/B. Firstly row $r_1$ together with row $r_3$ is addressed (so row $r_1$ and $r_3$ are driven with the same data, while skipping row $r_2$), next row $r_5$ together with row $r_7$ is addressed. Once all odd rows are addressed (all A, B patterns), the skipped even rows are addressed (all A', B' patterns), so row $r_2$ together with row $r_4$, next row $r_6$ together with row $r_8$, etc. The advantage of this scheme is that also the small crosstalk, which could arise from addressing at the same time adjacent lines containing the same data, is avoided.

The invention and some of the most important embodiments may be summarized as follows:

A display device (1) of the matrix type is addressed using partial line doubling, i.e. a method in which sub-fields for pixels are doubled, i.e. the same data is used for a set of pixels. Adjacent pixels in a row either are addressed in different non-binary codes or, when the pixels are addressed in binary codes, have different temporal sequences for the binary codes for adjacent pixels. Partial line doubling is performed on sets of adjacent pixels in a column that are addressed in the same non-binary code or in the same temporal sequence. Two different addressing schemes may be used, either by applying the standard pattern A/B or the second pattern n×1 A/B. In the latter scheme partial line doubling is performed in a line skipping fashion. It is possible to interchange lines and columns. The invention is applicable to display devices in which the sub-field mode is applied.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements, and by means of a suitably programmed computer. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A method of determining new luminance value data to be displayed on a matrix display device, having pixels arranged in lines of rows and columns, said new luminance value data being based on original luminance value data which are coded to allow more than one grey level realization for a grey level to be displayed on said matrix display device by applying mutually different combinations of sub-fields said new luminance value data being coded in sub-fields wherein common values for a number of sub-fields are determined for a set of rows, characterized in that the method comprises the steps of:

determining, for pixels which are adjacent to each other in a row of said set of rows and which have the same grey level, mutually different grey level realizations; and determining the common values for sub-fields of the pixels in a column comprised by pixels from said set of rows, the pixels having the same grey level realization, so as to enable simultaneous addressing of the set of rows for the subfields having common values.

2. The method as claimed in claim 1, characterized in that for the sub-fields having the lowest one or two weight no common values are determined, while for one or more sub-fields having higher weights, said common values are determined.

3. The method as claimed in claim 1, characterized in that pixels adjacent to each other in a column have different grey level realizations.

4. The method as claimed in claim 3, characterized in that the common values are determined for pairs of adjacent odd lines, and pairs of adjacent even lines, respectively.

5. The method as claimed in claim 3, characterized in that the non-doubled sub-fields are addressed in an interlaced way.

6. The method as claimed in claim 1, characterized in that pairs of pixels adjacent to each other in a column have the same grey level realization.

7. The method as claimed in claim 6, characterized in that adjacent pairs of pixels in a column have different grey level realizations.

8. The method as claimed in claim 6, characterized in that the non-doubled sub-fields are addressed in an interlaced way.

9. A matrix display device comprising:

a display panel having pixels arranged in rows and columns;

a data-processing unit for receiving an input signal representing successive frames comprising original luminance value data coded to allow more than one grey level realization for a grey level to be displayed on said display panel by applying mutually different combinations of subfields, said data-processing unit determining new luminance value data on the basis of the original luminance value data, wherein said new luminance value data are coded in subfields and common values for a number of subfields are determined for a set of rows; and a driver circuit for supplying the new luminance value data to said rows and columns of said display panel, said driver circuit having means for addressing said set of rows with the values for selected sub-fields, characterized in that said data-processing unit determines, for pixels which are adjacent to each other in a row of said set of rows and which have the same grey level, mutually different grey level realizations, and in that said data-processing unit determines the common value for subfields of the pixels in a column formed by pixels from said set of rows, the pixels having the same grey level realization, so as to enable simultaneous addressing of the set of rows for the subfields having common values.

* * * * *